US007252153B2

(12) United States Patent
Hejl et al.

(10) Patent No.: US 7,252,153 B2
(45) Date of Patent: Aug. 7, 2007

(54) BI-DIRECTIONAL FLUID LOSS DEVICE AND METHOD

(75) Inventors: David A. Hejl, Houston, TX (US); W. David Henderson, Tioga, TX (US); W. Mark Richards, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 73 days.

(21) Appl. No.: 11/048,585

(22) Filed: Feb. 1, 2005

(65) Prior Publication Data

US 2006/0169465 A1 Aug. 3, 2006

(51) Int. Cl.
*E21B 34/10* (2006.01)
*E21B 34/14* (2006.01)

(52) U.S. Cl. ..... 166/386; 166/332.8; 166/319; 166/324; 166/332.1

(58) Field of Classification Search ..... 166/332.8, 166/386, 319, 321, 332.1, 332.5, 332.4, 332.7, 166/324

See application file for complete search history.

(56) References Cited

U.S. PATENT DOCUMENTS

| | | | | |
|---|---|---|---|---|
| 4,478,286 | A * | 10/1984 | Fineberg | 166/324 |
| 5,884,705 | A * | 3/1999 | Hill, Jr. | 166/324 |
| 6,079,497 | A * | 6/2000 | Johnston et al. | 166/324 |
| 6,230,808 | B1 | 5/2001 | French et al. | 166/323 |
| 6,808,020 | B2 * | 10/2004 | Garcia et al. | 166/373 |
| 2003/0079880 | A1 * | 5/2003 | Deaton et al. | 166/332.8 |
| 2006/0196675 | A1 * | 9/2006 | Patel et al. | 166/374 |

* cited by examiner

*Primary Examiner*—David Bagnell
*Assistant Examiner*—Robert Fuller
(74) *Attorney, Agent, or Firm*—Albert C. Metrailer

(57) ABSTRACT

A fluid loss device including a flapper and seat assembly that provide a seal on a lower flapper surface when the flapper is closed and resists pressure in either direction. The flapper and seat assembly is spring biased to contact a flapper support above the flapper to resist deformation of the flapper due to a pressure differential from below the flapper. The flapper and seat assembly may be moved by tubing pressure to release an opening prop that opens the flapper. The valve seat may include an elastomeric seal element to improve the fluid flow restriction. The flapper and seat assembly is also biased upward by a pressure differential from below to above the flapper, to thereby increase the flapper to valve seat pressure as the fluid pressure differential increases.

19 Claims, 11 Drawing Sheets

BI-DIRECTIONAL FLUID LOSS DEVICE AND METHOD

CROSS-REFERENCE TO RELATED APPLICATIONS

This application is related to U.S. patent application Ser. No. 11/048,476, entitled "Positioning Tool with Valved Fluid Diversion Path", filed on even date herewith and hereby incorporated by reference for all purposes.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to fluid loss devices for use in oil wells, and more particularly to flapper valves that may be closed to hold pressure in both directions.

BACKGROUND OF THE INVENTION

Oil wells are drilled from the surface of the earth down to and through hydrocarbon bearing formations to allow recovery of the hydrocarbons through the well. The wells are often cased down to the producing formation. The well may be cased or lined with a metal liner through the producing formation or may be left in open hole condition in the producing formation, i.e. without a casing or liner. If a well is cased or lined in the producing formation, the casing or liner is typically perforated to allow hydrocarbons to flow from the formation into the well for production.

In many wells, whether cased and perforated or left in open hole condition in the productive formations, particulates, e.g. sand, may flow from the formation with the produced hydrocarbons. The produced sand may erode and otherwise damage metal liners, casing, valves, etc. and must be removed from the produced fluids at the surface and then safely disposed of. To minimize sand production, it is common practice to gravel pack such wells as part of the completion process.

A gravel packing system typically includes a filter element, e.g. a wire wrapped screen, that is positioned in the well near a productive formation, e.g. adjacent perforations. The screen is carried into a well on a work string that includes a packer that seals the annulus between the work string and a cased portion of the well above the productive formation. A slurry of gravel packing liquid and particulates, typically referred to as gravel, may then be flowed down the work string. A cross over device is normally included to direct the slurry flow from inside the work string above the packer to the annulus around the screen below the packer. The screen allows the liquid to flow into the interior of the screen, but blocks the flow of the particulates to fill the annulus around the screen with the particulates, i.e. to gravel pack the annulus. The liquid flows back up the work string to the crossover, where it is directed into the annulus above the packer and may be returned to the surface location of the well.

Gravel packing is normally done in an overbalanced condition, i.e. with the pressure in the well at the screen higher than the natural formation pressure. Borehole fluids therefore tend to flow into the formation. To avoid fluid loss and possible formation damage, a fluid loss device may be included in a gravel packing work string between the screen and the packer. A fluid loss device typically includes some type of valve, e.g. a ball valve or a flapper valve, that may be closed when gravel packing is completed. The valve may be closed when a wash pipe is withdrawn from the assembly after the gravel packing operation. The closed valve isolates the productive formation from borehole pressure and fluids above the valve. This allows the well fluids to be circulated, e.g. to remove any remaining particulates or other treating fluids, without losing fluids into the formation. When production tubing has been installed in the well, the fluid loss valve is typically opened permanently to allow production of hydrocarbons through the valve and up the production tubing.

Such fluid loss devices may also be useful with other well treatment systems and processes. For example, filter cake in an open hole completion may prevent large fluid losses. It is normally desirable to remove the filter cake before producing the well, for example by an acidizing treatment. After the filter cake is removed, fluid losses may be a problem. Therefore, it may be desirable to include a fluid loss device in such treatment systems to limit fluid losses in the productive zone while the well is circulated to remove any treating fluids, e.g. acid, from the well above the producing formation.

SUMMARY OF THE INVENTION

Embodiments of the invention provide a fluid loss device including a flapper valve, i.e. a flapper and seat assembly, that provides a seal on one flapper surface when the flapper is closed and resists pressure in either direction. The flapper and seat assembly is spring biased to contact a flapper support above the flapper to resist deformation of the flapper due to a pressure differential from below the flapper. The flapper and seat assembly may be moved by tubing pressure to release an opening prop that opens the flapper.

In one embodiment, the valve seat includes an elastomeric seal element to improve the fluid flow restriction, especially from below to above the flapper.

In one embodiment, the flapper and seat assembly is also biased upward by a pressure differential from below to above the flapper, to thereby increase the flapper to valve seat pressure as the fluid pressure differential increases.

In one embodiment, the opening prop opens a port to equalize pressure across the flapper before the opening prop opens the flapper.

In one embodiment, a run in prop holds the flapper open during run in and well treatment, and is movable to close the flapper.

DETAILED DESCRIPTION OF THE PREFERRED EMBODIMENTS

In describing the embodiments of the present invention, various elements are referred to by their normal relative positions when used in an oil well. The terms above or up hole mean that an element is closer to the surface location of a well. The terms below or down hole mean that an element is closer to the end of the well farthest from the surface location. In deviated or horizontal wells, the various elements may actually be at the same vertical elevation. Such terms are not meant to limit the orientation in which a device may be operated in a well, but only to help understand the relative positions of elements that make up the device.

In describing a flapper valve, i.e. a flapper and valve seat, references are made to pressures relative to the flapper. The terms pressure from below and pressure from below to above mean that the pressure below the flapper is greater than the pressure above the flapper. The terms pressure from above and pressure from above to below mean that the pressure above the flapper is greater than the pressure below the flapper.

It is understood that a purpose of a fluid loss device is to hold pressure from above and/or below the device. A perfect seal against fluid flow through the device is not essential to effectively holding the pressure. In most formations, the permeability is sufficient that a small fluid leakage past a fluid loss device has essentially no affect on pressure isolation by the device.

Various embodiments of the present invention provide fluid loss devices for use in oil wells having flapper valves that in a closed position holds pressure in both directions with a valve seat on only one side and may be opened by fluid pressure.

Figure 1A:
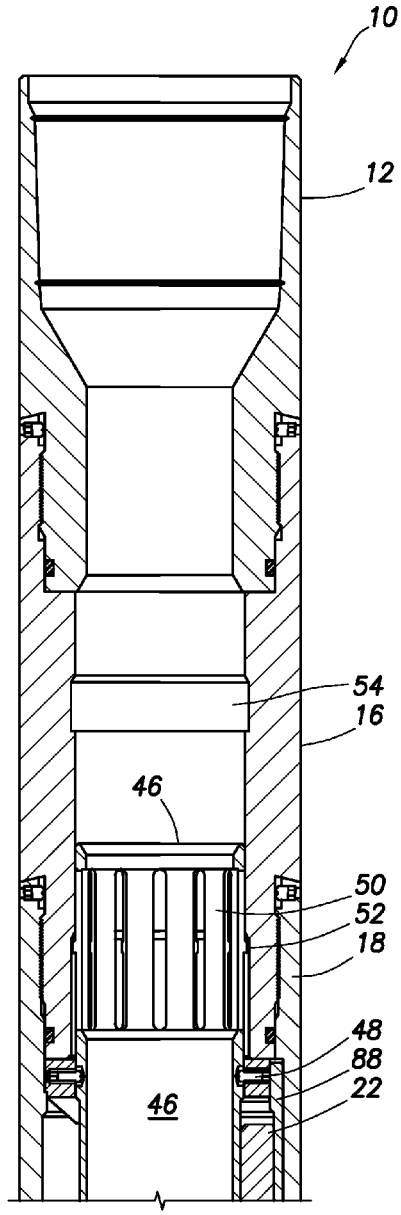
FIGS. 1A, 1B, and 1C, together are a cross sectional view of a fluid loss device according to one embodiment in a run in condition.
Figure 1B:
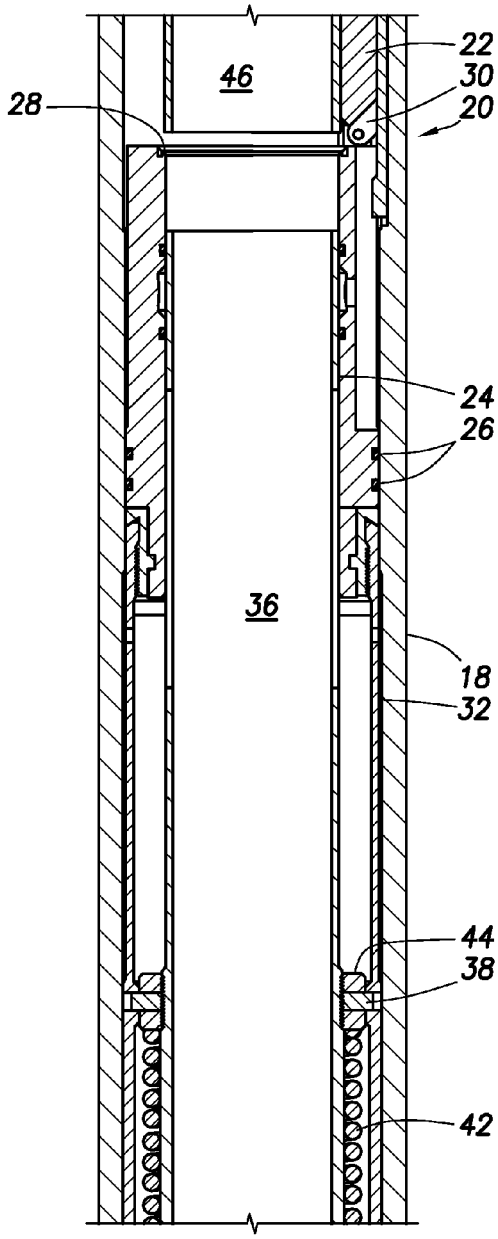
Figure 1C:
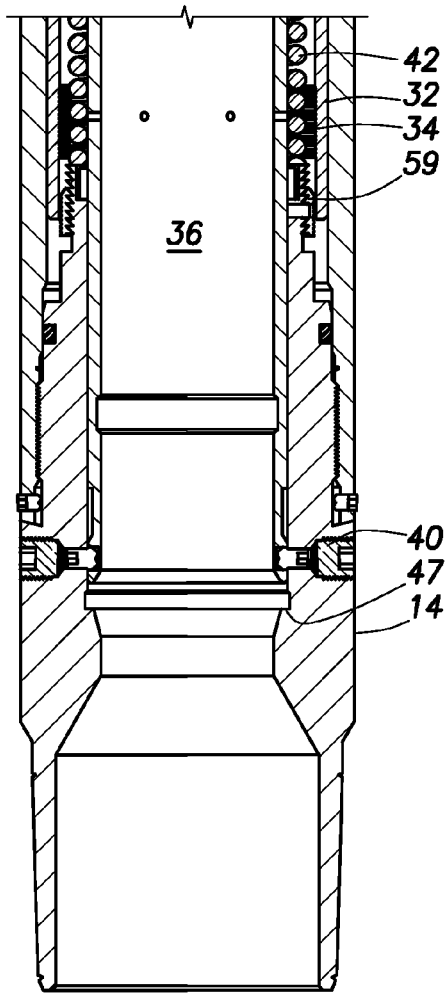

FIGS. 1A, 1B, and 1C together provide an illustration of a fluid loss device 10 according to an embodiment in a run in condition. The device 10 includes an upper tubing connector 12 and a lower tubing connector 14 adapted to allow the device 10 to be assembled into a work string. The lower end of upper connector 12 is threaded to the upper end of a run in prop sub 16. The lower end of sub 16 is threaded to the upper end of an outer sleeve 18. The lower end of sleeve 18 is threaded to the upper end of lower connector 14. Each of these threaded connections is preferably provided with a fluid tight seal, e.g. an O-ring. These elements 12, 16, 18 and 14 provide a substantially constant outer diameter over the length of the device 10 and do not move relative to one another once assembled as shown. These elements provide a structural outer housing within which various movable elements operate as described below.

A flapper valve assembly 20 is carried within the sleeve 18. The flapper assembly 20 includes a flapper 22, shown in more detail in FIG. 8, and a flapper carrier 24 that may slide axially within the sleeve 18 with a fluid seal provided by O-rings 26. A valve seat 28 is formed on the upper end of the carrier 24 and is adapted to form a fluid tight seal with a lower surface of the flapper 22. The flapper 22 and carrier 24 are connected by a hinge 30 that preferably includes a spring, not shown, that urges the flapper 22 into a closed position. The lower end of carrier 24 is threaded to the upper end of a lockout sleeve 32 that is slidably carried on the inner surface of sleeve 18. A set of ratchet teeth 34 are formed on an inner surface of lockout sleeve 32 at its lower end. The connection between carrier 24 and lockout sleeve 32 is fixed so that the two parts move together.

An opening prop or sleeve 36 is carried within the lockout sleeve 32. A prop as used herein is any element having a function of holding a flapper in an open position, i.e. resisting forces that tend to close the flapper. A prop may also function to release an open flapper to move into a closed position and/or to move a closed flapper to an open position. The opening prop 36 is releasably connected to the lockout sleeve by shear pins or screws 38. The opening prop is releasably connected to the upper end of lower tubing connector 14 by shear pins or screws 40. A spring 42 is carried in an annulus between opening prop 36 and the lockout sleeve 32. In this run in condition, the spring 42 is compressed between the upper end of lower tubing connector 14 and a ring 44 threaded onto the opening prop 36. The shear pins 38 are carried in the ring 44. While a coil spring 42 is used in this embodiment, it is apparent that other forms of springs may be substituted if desired. For example, a compressed gas cylinder and piston could be used in place of the spring 42.

In this run in condition, the lower end of the opening prop 36 is positioned a short distance above a shoulder 47 near the center of lower tubing connector 14. This short distance is selected to allow the shear pin 40 to be completely sheared when the opening prop 36 is moved down into contact with the shoulder 47. The shear pins 40 are selected to have sufficient strength to hold spring 42 in a compressed state in this run in condition.

In the run in condition, the flapper 22 is held in its open position by a lower portion of a run in prop 46. The run in prop 46 is releasably held in the run in position by shear pins or screws 48 coupled to a flapper support 56, shown in more detail in FIGS. 2A and 7. The upper end 50 of the run in prop 46 is slotted to form a collet section including outer tines 52 adapted to engage a recess 54 on the inner surface of sub 16 when the run in prop is moved upward to release the flapper 22.

The run in position of fluid loss device 10 shown in FIGS. 1A, 1B and 1C provides an open bore or slick bore through which fluids may flow without restriction equivalent to a conventional length of oilfield tubing. The upper and lower connectors 12, 14 are threaded for connection to conventional tubing. The device 10 may therefore be conveniently assembled into a work string for well treating, e.g. a gravel packing work string or an acidizing work string, as desired.

Figure 2A:
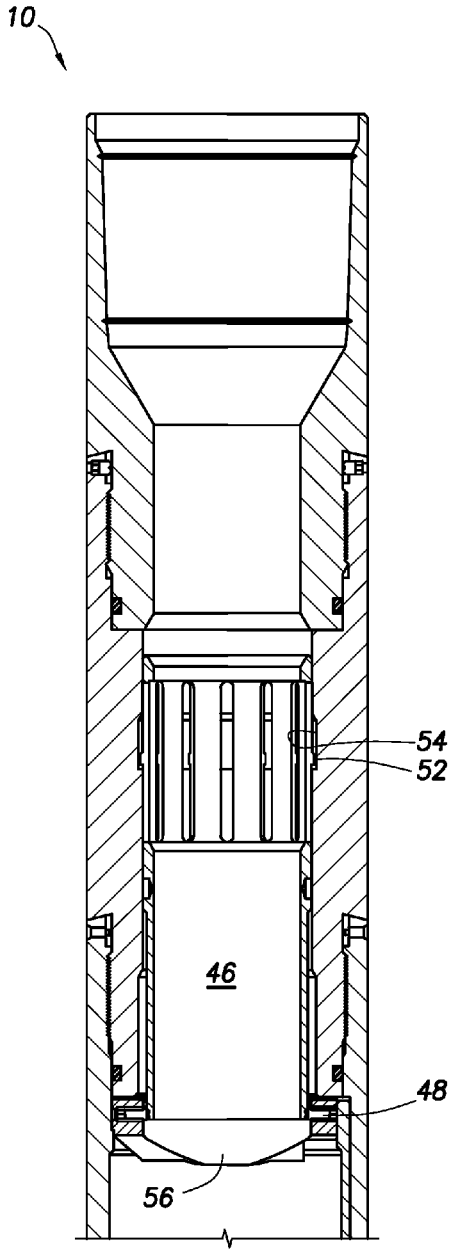
FIGS. 2A, 2B, and 2C, together are a cross sectional view of a fluid loss device according to one embodiment with a flapper closed and subject to pressure from above.
Figure 2B:
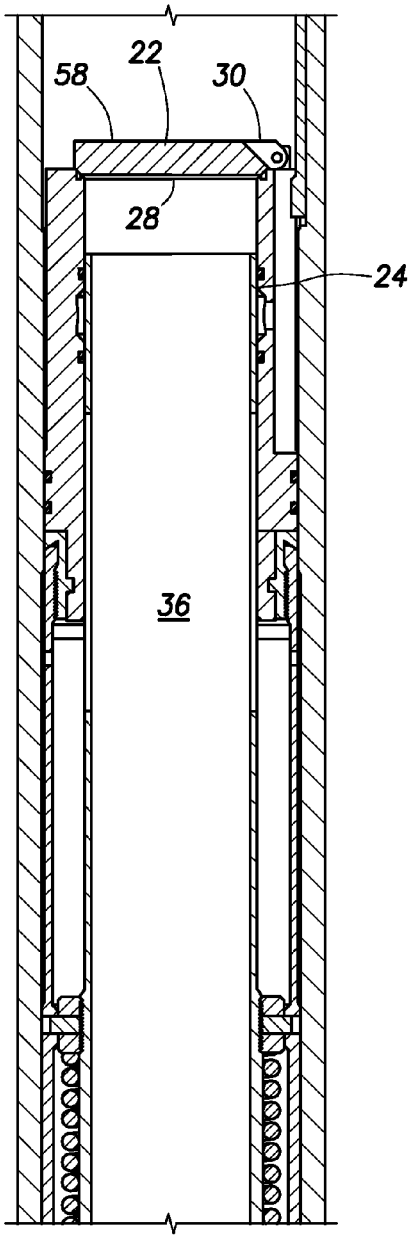
Figure 2C:
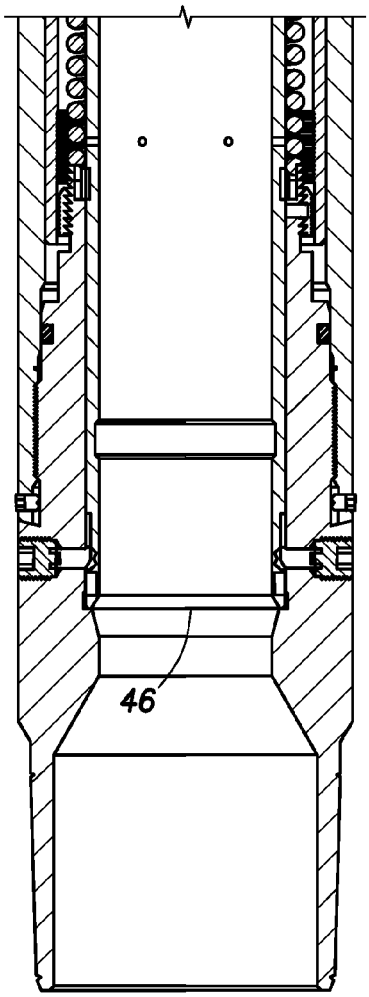

FIGS. 2A, 2B and 2C together illustrate the fluid loss control device 10 with various movable elements positioned as they would typically be after a well treatment. For purposes of this description, it will be assumed that the device 10 has been installed in a gravel packing system and the gravel packing operation has been completed. During a gravel packing operation, a wash pipe would normally extend through the device 10 and into a sand screen below device 10 that is being gravel packed. A shifting tool may be carried on the lower end of the wash pipe. At the end of a gravel packing operation, the wash pipe would typically be withdraw from the well and the shifting tool would be the last element pulled up through the device 10. As shown in FIG. 2A, the shifting tool has moved the run in prop upward, shearing the pin 48 and causing the collet tines 52 to engage the sub 16 recess 54. The run in prop 46 is effectively locked into this upper position. If desired, the shifting tool may be run into the well on another work string, a slick line, coiled tubing, etc. and operated independently of the well treating work string.

When the run in prop 46 is moved to the upper position, the flapper 22 is released and a weak spring, not shown, in the hinge 30 swings the flapper 22 down into contact with the valve seat 28 on the upper end of carrier 24. As noted in the background section, well treatments are normally performed in an overbalanced condition. When the flapper 22 closes, the pressure above flapper 22 will normally be greater than the pressure below flapper 22. As shown in FIGS. 2B and 2C, the pressure above flapper 22 has moved the flapper 22, carrier 24, lockout sleeve 32, and opening prop 36 down until the lowermost end of opening prop 36 has contacted the shoulder 47 on lower connector 14. This movement is sufficient to shear the pins 40 that held the spring 42 in its compressed condition. The spring 42 has therefore been released to drive the complete assembly of flapper 22, carrier 24, lockout sleeve 32, and opening prop 36 upward. However, since the hydraulic pressure above flapper 22 provided sufficient force to drive these parts downward and shear the pins 40, they will stay in this position until the pressure above flapper 22 is reduced to a value providing less force than the force provided by the spring 42.

If the pressure above flapper 22 is not sufficient to shear pins 40, a mechanical device may be used to apply downward force on the flapper 22 to shear the pins 40. Since pins 40 are desirable sheared after a shifter tool has moved the run in prop 46 and allowed the flapper 22 to close, the shifter tool itself may be used to apply the force. That is, the shifter tool may be lowered back down on top of the closed flapper 22 with the proper force to shear pins 40 before being removed from the well.

Figure 7:
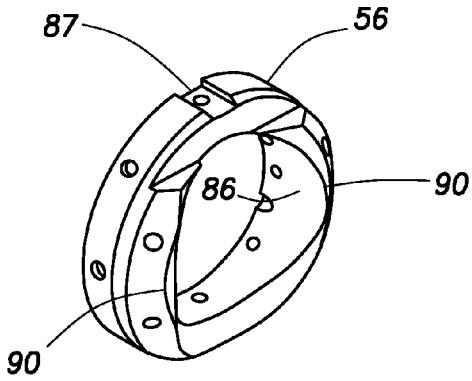
FIG. 7 is a perspective view of a flapper support according to one embodiment.

FIG. 2A also illustrates a flapper 22 support 56 that is mostly hidden in FIG. 1A, and is illustrated in more detail in FIGS. 2A and 7. The support 56 has a lower surface shaped to conform to a substantial portion of the outer periphery of the upper surface 58 of the flapper 22. In this embodiment, the lower surface of the flapper 22 is essentially flat with a beveled surface on the periphery, which beveled surface is shaped to form a fluid tight seal with the valve seat 28. As well known in the art, it is desirable that a flapper 22 in its open position, FIGS. 1A and 1B, not extend into the inner bore of a fluid loss device so as to not restrict fluid flow or restrict positioning of other elements, such as wash pipes, through the device. The upper surface of the flapper 22 may therefore be desirably formed somewhat in the shape of a cylinder to conform to the inner surface of the sleeve 18. As a result, two opposite edges of the flapper 22 are thinner than its central portion. In this invention, the seal between the lower edge of flapper 22 and seat 28 provides a pressure seal to pressure from below flapper 22 as well as pressure from above. Since the flapper has non uniform thickness, pressure from below tends to deform the thinner and weaker portions of the flapper 22 and tends to cause some leakage if sufficient pressure is applied from below to above the flapper 22. In the present invention, the support 56 is provided to resist deformation of the flapper 22 that could otherwise be caused by pressure from below. While the support 56 does not necessarily form a valve seat, i.e. does not form a fluid tight seal with the upper surface of flapper 22, it does form an intimate contact with a substantial portion of the periphery of the flapper 22, primarily those portions of the periphery where the flapper may be thinned to fit in its open position.

Figure 3A:
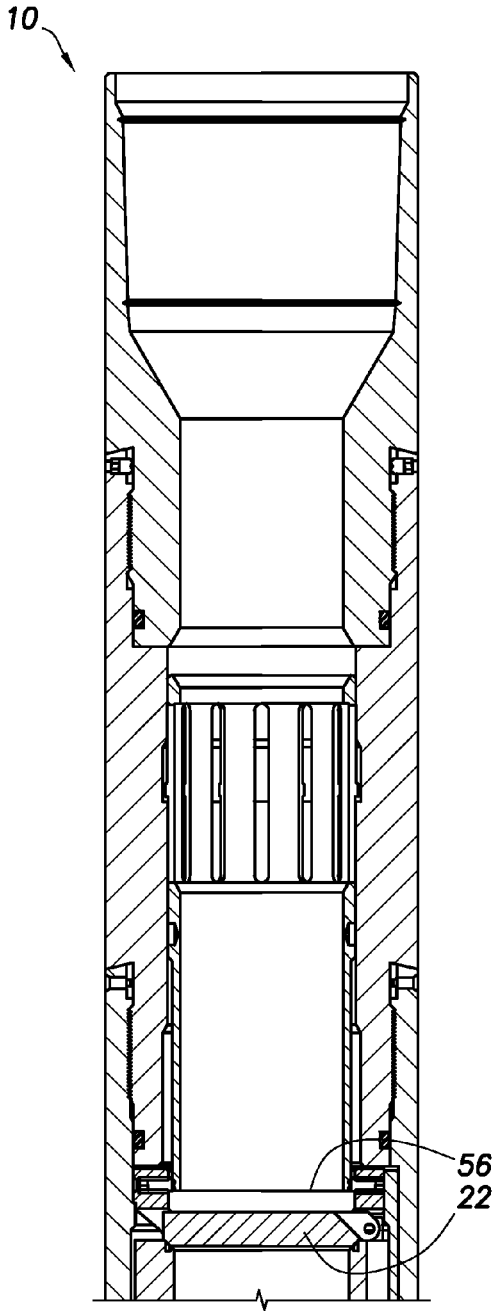
FIGS. 3A, 3B, and 3C, together are a cross sectional view of a fluid loss device according to one embodiment with a flapper closed and subject to pressure from below.
Figure 3B:
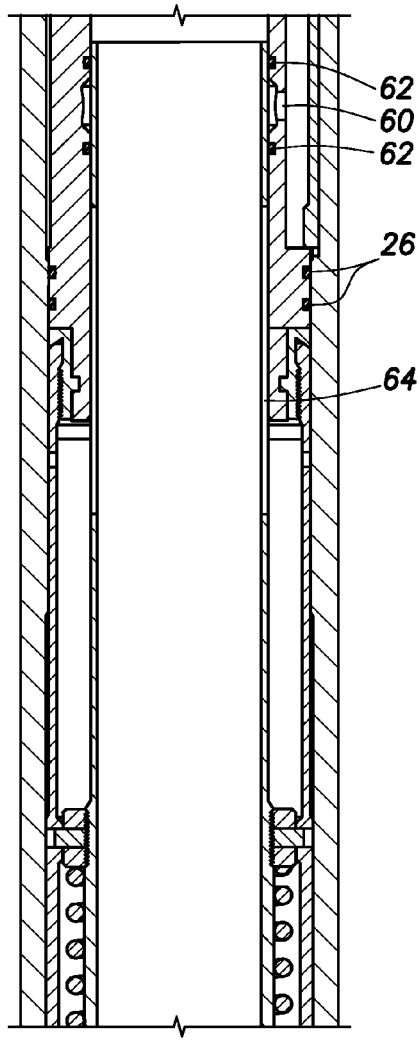
Figure 3C:
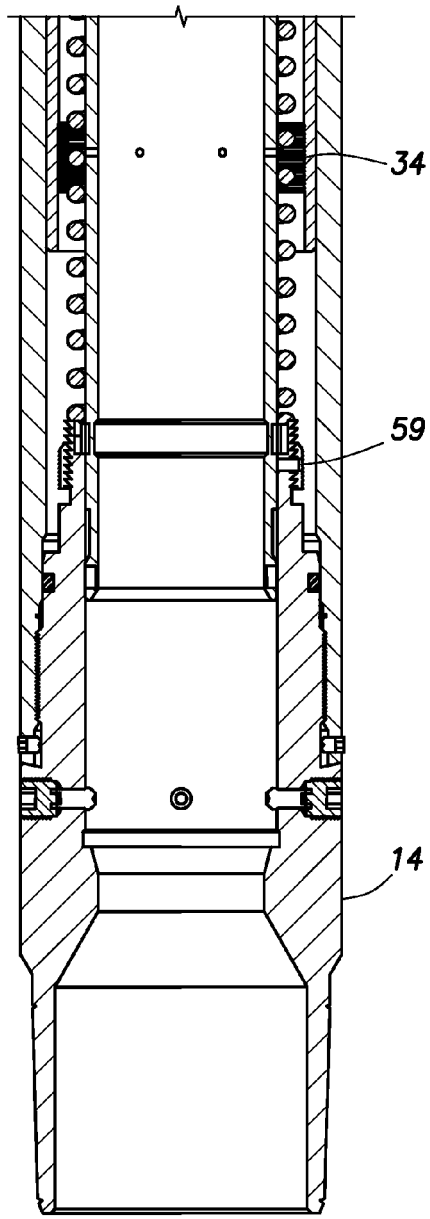

FIGS. 3A, 3B, and 3C illustrate the fluid loss device 10 in a condition in which the pressure below flapper 22 is about equal to or greater than pressure above flapper 22. Such a condition may occur as fluids are circulated in the well above device 10 to clean out treatment fluids. Note that the total force below flapper 22 includes the force of the spring 42 as well as the force provided by fluids below the flapper 22. In this pressure condition, the assembly of flapper 22, carrier 24, lockout sleeve 32, and opening prop 36 moves upward until the top 58 of flapper 22 contacts the support 56. The support 56 resists deflection or deformation of the flapper 22 so that it maintains a substantially fluid tight seal with the valve seat 28.

In this embodiment, the fluid pressure below flapper 22 also increases the contact pressure between the flapper 22 and the valve seat 28. The carrier 24 forms an annular piston sliding within the sleeve 18. Pressure differences above and below carrier 24 are isolated by the O-rings 26. As pressure below flapper 22 increases, the upward force produced by the carrier 24 not only increases the force between the flapper 22 and valve seat 28, but also the force between the flapper 22 and the flapper support 56. Thus, the flapper 22 is effectively at least as stiff or rigid with respect to fluid forces from below as the support 56. The result is that the seal between the flapper 22 and seat 28 is maintained despite substantial pressure differential from below to above the flapper 22.

In some cases, the pressure above flapper 22 may cycle several times between being greater, within certain limits, than the pressure below flapper 22 and being less than the pressure below flapper 22. This may occur as a result of changes in the fluid composition above flapper 22, as a result of intentional pressure changes for testing, packer inflation, etc. As such cycles occur, the assembly of flapper 22, carrier 24, lockout sleeve 32, and opening prop 36 will move between the position shown in FIGS. 2A, 2B, 2C and the position shown in FIGS. 3A, 3B, and 3C. During all such cycles, the flapper 22 will remain closed and the fluids will be prevented from leaking off into the productive formation or being produced from the productive formation into the tubing above the flapper 22.

Figure 4A:
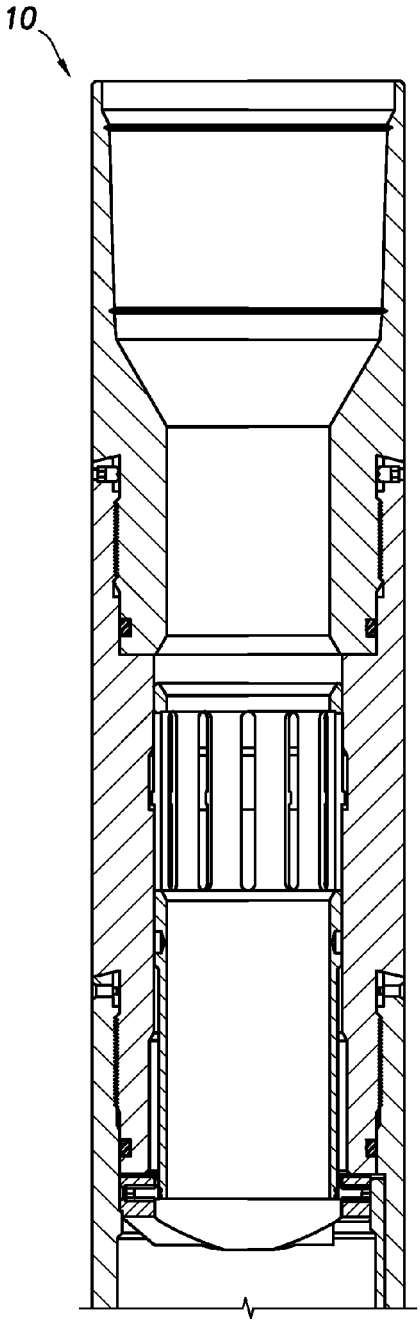
FIGS. 4A, 4B, and 4C, together are a cross sectional view of a fluid loss device according to one embodiment with a flapper closed and subject to pressure from above sufficient to unlock an opening prop.
Figure 4B:
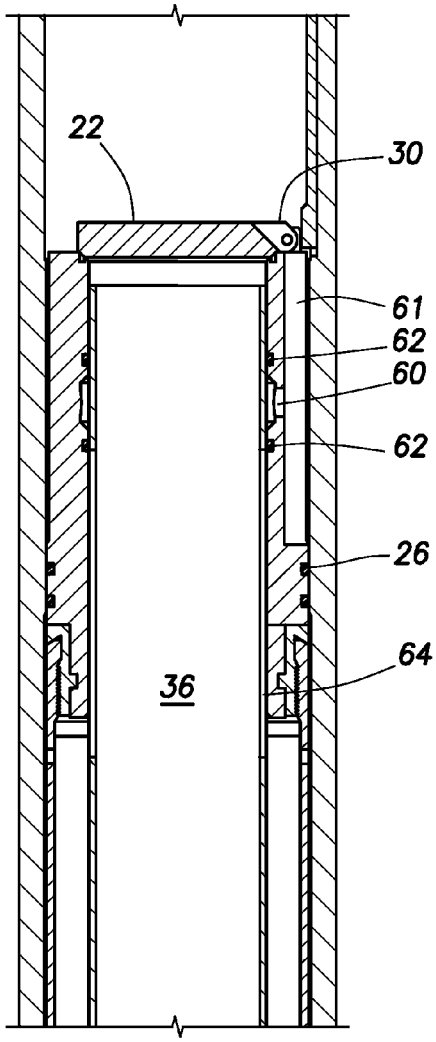
Figure 4C:
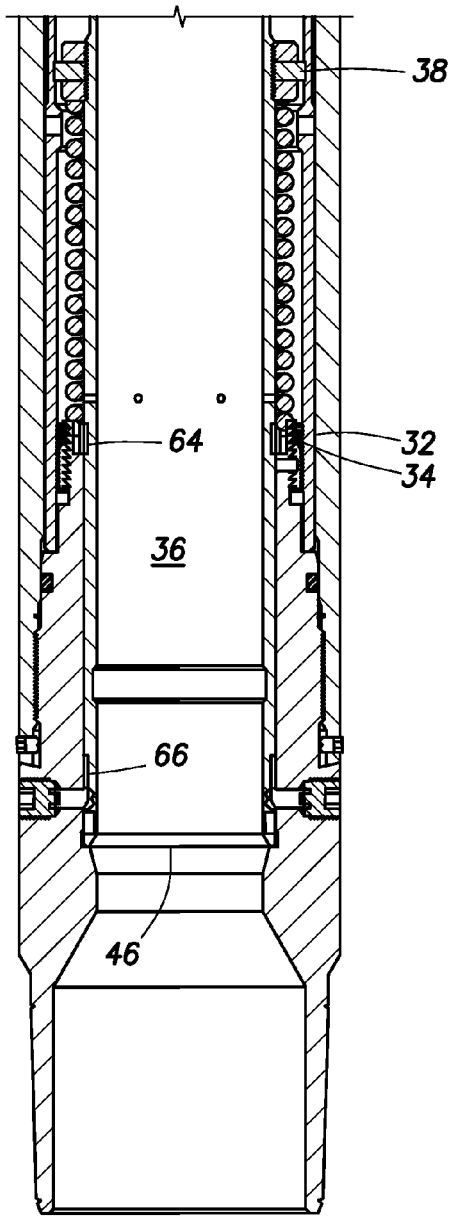

FIGS. 4A, 4B and 4C illustrate the fluid loss device 10 in a first phase of opening the flapper 22. The flapper 22 may be opened by increasing the fluid pressure above flapper 22 to a preselected level that preferably is above any pressure level required for other operations occurring after the device 10 is down hole, but before opening the flapper 22. As the pressure is increased, the assembly of flapper 22, carrier 24, lockout sleeve 32, and opening prop 36 move down until the bottom of opening prop 36 contacts the shoulder 47. Then as pressure is further increased, the shear pin 38 between lockout sleeve 32 and opening prop 36 is sheared allowing the assembly of flapper 22, carrier 24, and lockout sleeve 32 to move further down. As the lockout sleeve 32 moves down, the ratchet teeth 34 on the inner surface of lockout sleeve 32 engage a matching set of ratchet teeth 59 on the lower connector 14. In one embodiment, the teeth 59 of lower connector 14 are formed on a separate ring threaded onto the connector 14, but the teeth 59 may be formed directly onto the connector 14 if desired. Once the ratchet teeth 34, 59 are engaged, the flapper carrier 24 and lockout sleeve 32 are prevented from moving up relative to the lower connector 14. However, since shear pin 38 is sheared, the opening prop 36 is now free to move upward to open the flapper 22 as a result of force provided by the spring 42.

As an alternative to using fluid pressure to open the flapper 22, a mechanical device may be lowered down a well to contact the flapper 22 and provide sufficient force to move the device 10 to the configuration shown in FIGS. 4A, 4B, and 4C. The mechanical device could then be lifted to allow the opening prop 36 to move the flapper 22 to its open position.

Figure 5A:
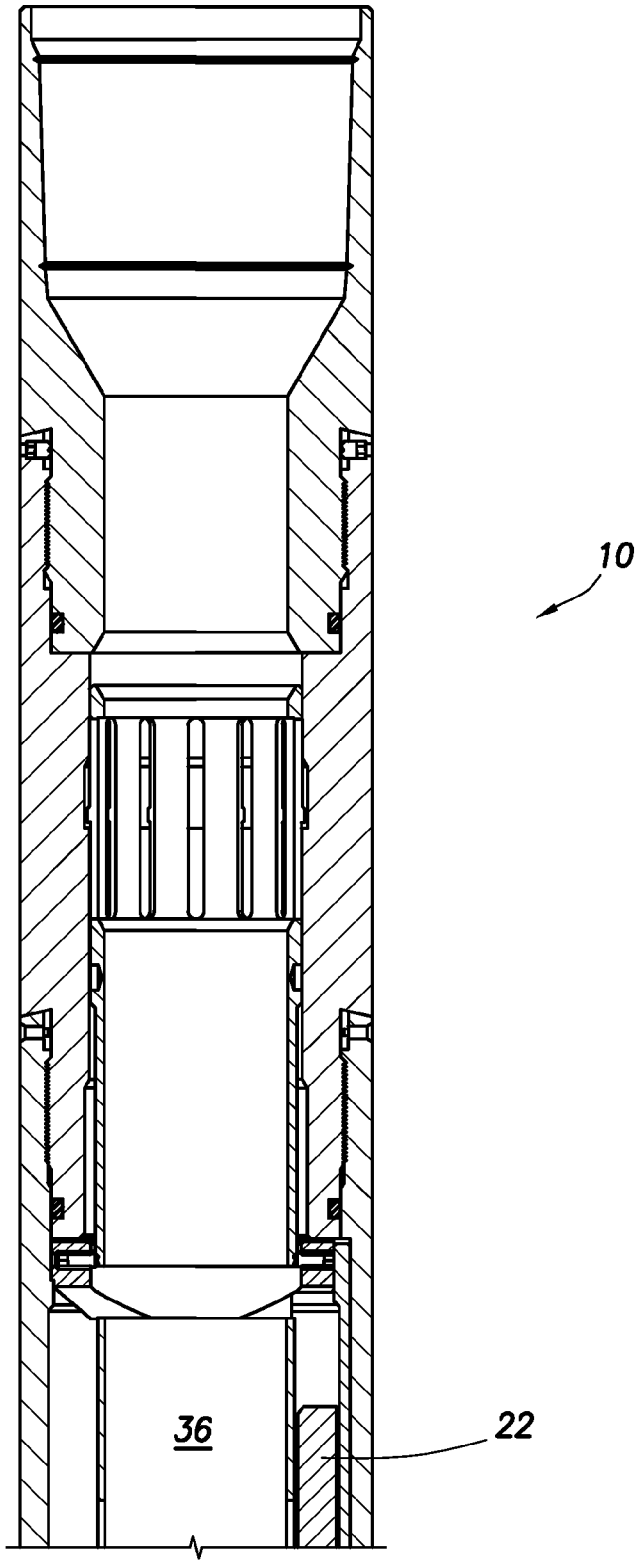
FIGS. 5A, 5B, and 5C, together are a cross sectional view of a fluid loss device according to one embodiment with a flapper opened by the opening prop.
Figure 5B:
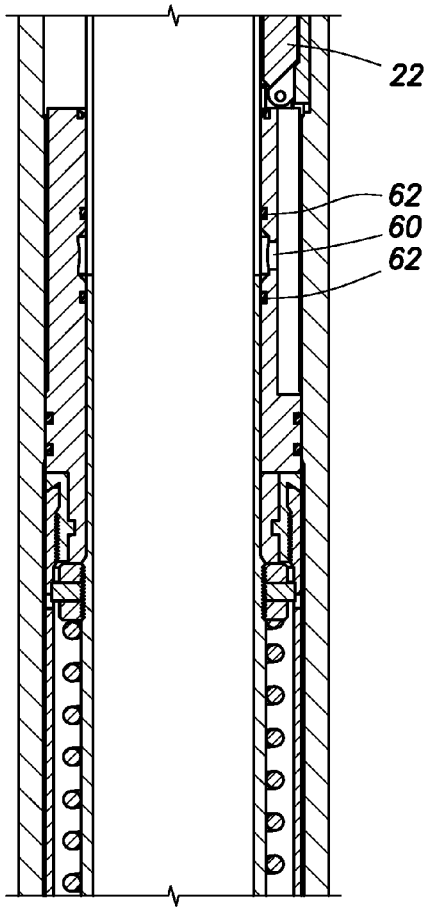
Figure 5C:
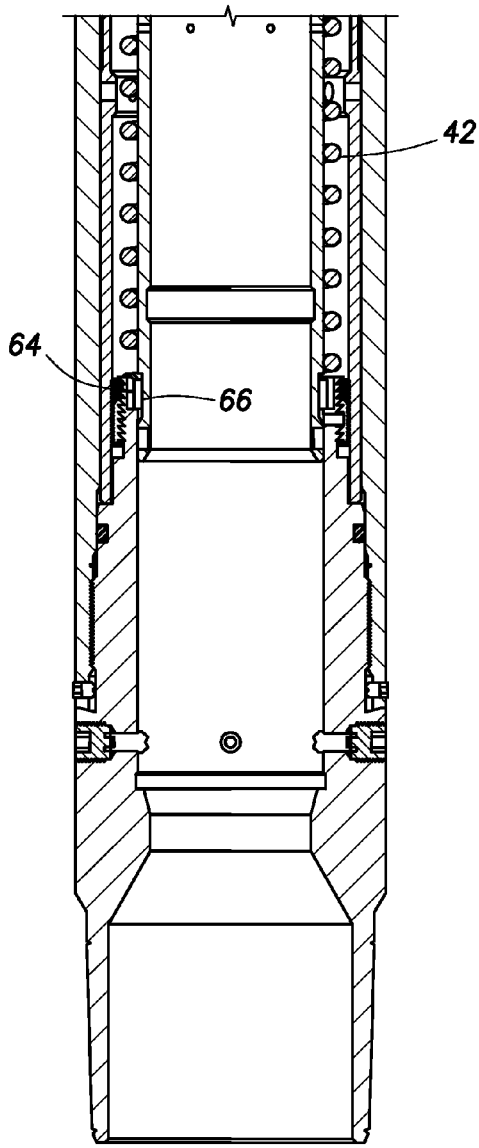

FIGS. 5A, 5B and 5C illustrate the device 10 in its final configuration in which the flapper 22 has been permanently opened. The spring 42 has moved the opening prop 36 upward pushing the flapper 22 open and holding it open. As noted above, opening of the flapper 22 is initiated by application of fluid pressure above the flapper 22. This pressure may be high enough that the spring 42 may not be strong enough to force the flapper 22 open, but the flapper will open when the pressure is reduced or is equalized across the flapper 22. For example, the pressure may be equalized sufficiently by simply reducing the pressure that was intentionally applied from the surface to initiate opening of the flapper 22 and/or changing out fluids above the flapper 22.

The disclosed embodiment provides an arrangement for equalizing pressure above and below the flapper 22 so that it may be opened by opening prop 36 and spring 42. A port 60 is provided through the wall of the carrier 24. The port 60 is initially closed by a portion of the opening prop 36 and a pair of O-rings 62 as shown in FIGS. 3B and 4B. A slot 64 is also provided in the opening prop 36 in alignment with the port 60. As the opening prop 36 moves upward and the upper end of the slot 64 passes the lower O-ring 62, fluid communication is provided between the fluids above and below flapper 22. When sufficient fluid has passed through the port 60, the pressures above and below flapper 22 will equalize sufficiently for the force of spring 42 to open the flapper 22 and move the opening prop 36 to it uppermost and final position. The opening prop 36 is preferably locked into this final position by a snap ring 64 carried on the lower connector 14 that moves partly into a groove 66 on the opening prop 36 when it reaches its final position.

The pressure equalizing feature provided by the present invention also prevents fluid shock to the producing formation that may occur with prior art flapper valves, e.g. those that are opened suddenly by breaking or shattering the valve. If the valve opens quickly, the high pressure used to open the valve may damage the producing formation or a gravel pack. In the present invention, the pressure equalization provided by fluids flowing through the port 60 and slot 64 occurs over a longer period of time and avoids a sudden pressure shock to the down hole equipment and formation.

The pressure equalizing arrangement also provides another advantage. During the time that the flapper 22 is closed, solid particles may settle out of fluids above the flapper 22 and build up on the upper surface 58 of the flapper 22 and in the hinge 30. Such solids may interfere with opening of flapper 22. The fluids that flow through the port 60 flow from a space 61, the upper end of which is located at the hinge 30. The well fluids therefore flow across the top of the flapper 22 and through the hinge 30. The flow of fluids tends to remove any solids that may have collected on the flapper 22 and particularly on the hinge 30.

Once the fluid loss device 10 has been configured as shown in FIGS. 5A, 5B, and 5C, a substantially unobstructed flow path is provided through the device 10 and production of hydrocarbons can begin from the productive formation.

Figure 6:
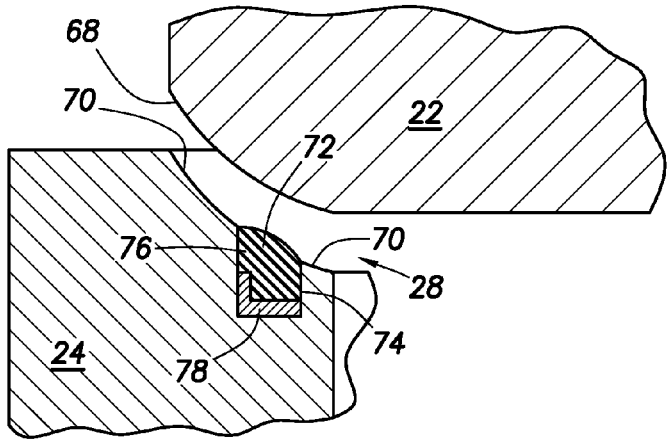
FIG. 6 is a partial cross sectional illustration of a flapper and valve seat according to one embodiment.

With reference to FIG. 6, more details of the flapper 22 and valve seat 28 formed on carrier 24 are shown. A beveled edge or sealing surface 68 is formed on the lower periphery of the flapper 22. In a preferred embodiment, the sealing surface 68 has a spherical shape. The valve seat 28 has a matching surface 70 that forms a essentially fluid tight metal to metal seal with the surface 68 when the flapper 22 is in contact with the seat 28. Testing indicates that this metal to metal seal effectively restricts fluid flow in either direction over an expected pressure range in the present invention.

In FIG. 6 there is also illustrated an optional back up elastomeric seal 72 formed in the valve seat 28, to provide improved sealing against fluid leaks, particularly those that could result from pressure below the flapper 22. In this embodiment, an annular groove or notch 74 is formed on the face of the seat 28, preferably closer to the inner surface of the carrier 24, than to the outer surface. The groove is filled with an elastomeric material 76, e.g. rubber, that extends slightly above the metal sealing surface 70. In a preferred embodiment, the material 76 may be bonded to a metallic back up ring 78 that is press fit into the groove 74. Alternatively the seal 72 may be made of other materials that are relatively soft, as compared to the flapper 22, such as plastics, e.g. Teflon or Delrin, or metals, e.g. copper or aluminum.

The flapper surface 68 and valve seat surface 70, and optionally the elastomeric seal 72, form an interface between the flapper 22 and valve seat 28 that is adapted to hold pressure in either direction, i.e. from above and from below the flapper 22. When holding pressure from below, the support 56 prevents deformation of the flapper 22 that may cause leakage, and allows sufficient force to be applied to the interface between the flapper 22 and valve seat 28 to hold pressure from below. The interface may form a fluid tight seal, but in any case holds pressure.

Figure 8:
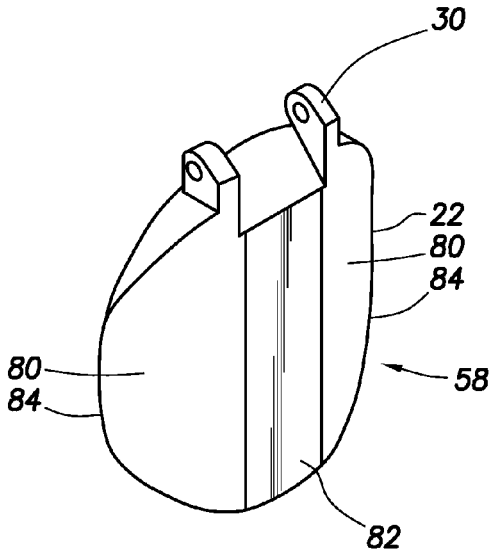
FIG. 8 is a perspective view of a flapper according to one embodiment.
Figure 10A:
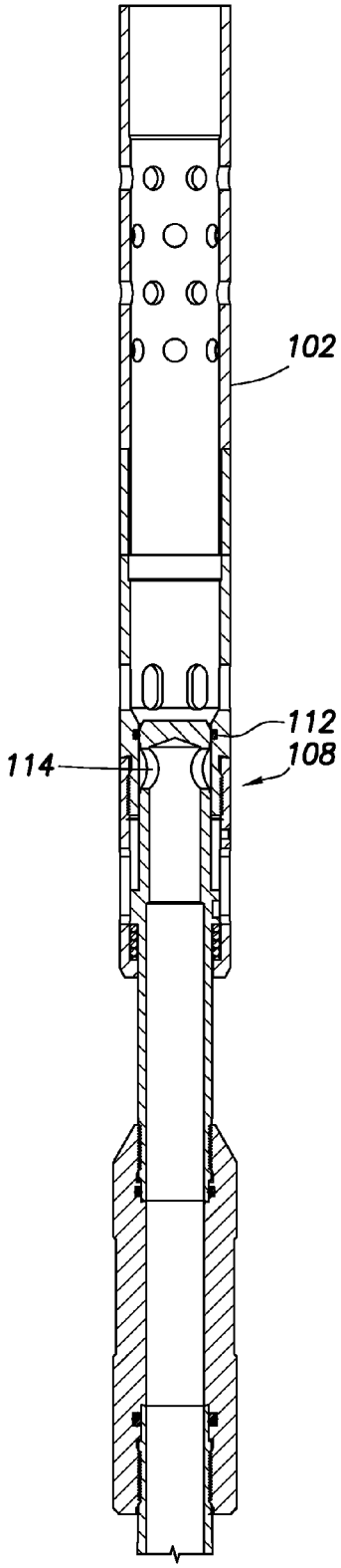
FIGS. 10A and 10B provide a cross sectional view of the positioning tool suitable for moving the run in prop in the fluid loss device in a second operating configuration.

FIGS. 7 and 8 are perspective views providing more details of a support 56 and flapper 22 according to one embodiment. The upper surface 58 of flapper 22 has a central raised portion 82 extending from the hinge 30 directly across the flapper 22 or to a position displaced 180 degrees from the hinge 30. The upper surface 58 of flapper 22 has a generally cylindrical shape as shown by the areas 80 extending from a central raised portion 82 to thin edges 84 or to positions displaced 90 degrees from the hinge 30. This shape is desirable so that the flapper 22 will conveniently fit in its open position without blocking the central bore of the device 10. However, as discussed above, the non-uniform thickness of flapper 22 could allow pressure from below to deform the flapper 22 so that it might not mate completely with the valve seat 28. A preferred embodiment provides the support 56 that mates with the thin edges 84 and resists deformation of the flapper 22 that might be caused by pressure from below.

The support 56 has a cylindrical central bore 86, through which the run in prop 46 is initially positioned. The support 56 includes a notch 87 on its outer edge that mates with a key 88, which key also mates with the carrier 24 at the center of hinge 30 to keep the flapper 22 and support 56 in proper angular alignment. Raised support surfaces 90 are provided on two sides of the support 56, each centered at a 90 degree displacement from the notch 86, and therefore centered on the thin edges 84 of the flapper 22. The support surfaces 90 each extend radially about 30 to 90 degrees, and preferably about 60 degrees, about the periphery of the support 56. If desired, the support 56 may also be shaped to contact the raised area 82 between the thin areas 80, but such contact is generally not needed and may complicate the device since one of these areas includes the hinge 30 area. The support surfaces 90 typically do not form a fluid tight seal with the flapper 22 and are not required to be continuous. The support surfaces are shaped, e.g. by machining or casting, to uniformly support portions of the periphery of the upper surface 58 of the flapper 22 each centered on the thin areas 84. The support areas 90 do not need to be smooth and continuous as normally required for a valve seat, but may instead be stippled or otherwise formed of a plurality of discrete contact points as long as they are spaced close enough to provide uniform support to the periphery of the flapper 22. As noted above in the preferred embodiment, when the flapper 22 is closed and forced upward into contact with the support 56, the flapper 22 and support 56 function as one piece effectively having a uniform thickness and stiffness that resists deformation that might otherwise be caused by pressure from below.

In this embodiment, the flapper 22 has an essentially flat lower surface and a curved upper surface. Other flapper shapes are known to those skilled in the art. For example, some flappers are curved on both their lower and upper surfaces and may have uniform thickness. Such a flapper is essentially a portion of a hollow cylinder. Other flappers may be flat on both upper and lower surfaces. It is apparent that in alternate embodiments, any flapper shape may be used, provided that a valve seat is provided that conforms to the lower surface of the flapper and a support is provided that conforms to and supports at least portions of the upper surface of the flapper.

As described above with reference to FIGS. 4A, 4B, and 4C and 5A, 5B, and 5C, the flapper 22 may be opened by application of pressure from above the flapper 22. The pressure also applies force to the carrier 24 to aid in driving the lockout sleeve 32 down and shearing pin 38 to release the opening prop 36. Even if flapper 22 is in its initial open position, it may be possible under certain conditions to apply sufficient force to the carrier 24 to unintentionally shear pins 38 and place the device 10 in its final open position prematurely. One such condition may occur when a well has been fractured and gravel packed and a large flow of well fluids into the formation is occurring. To stop the fluid loss, the run in prop 46 needs to be moved upward to close the flapper 22. If the flapper closes with a large flow of fluids, the sudden stop of the fluid flow may generate a pressure spike that could shear the pins and reopen the flapper 22. Some prior art shifting tools have been designed to restrict fluid flow through the fluid loss device to prevent such a slam shut condition. However, as such a device is moved into the fluid loss device 10 and the flow restrictor passes the flapper 22 and carrier 24, a large pressure differential may be generated across the carrier 24 and may drive it downward and release the opening prop 36.

FIGS. 9A, 9B, 10A and 10B, illustrate a positioning tool 100 with a valved fluid diversion or bypass path that may be used to move the run in prop 46, while reducing or avoiding excessive pressure drops across the flapper 22 and carrier 24, both during movement of the tool 100 into the fluid loss device 10 and during closing of the flapper 22.

Figure 9A:
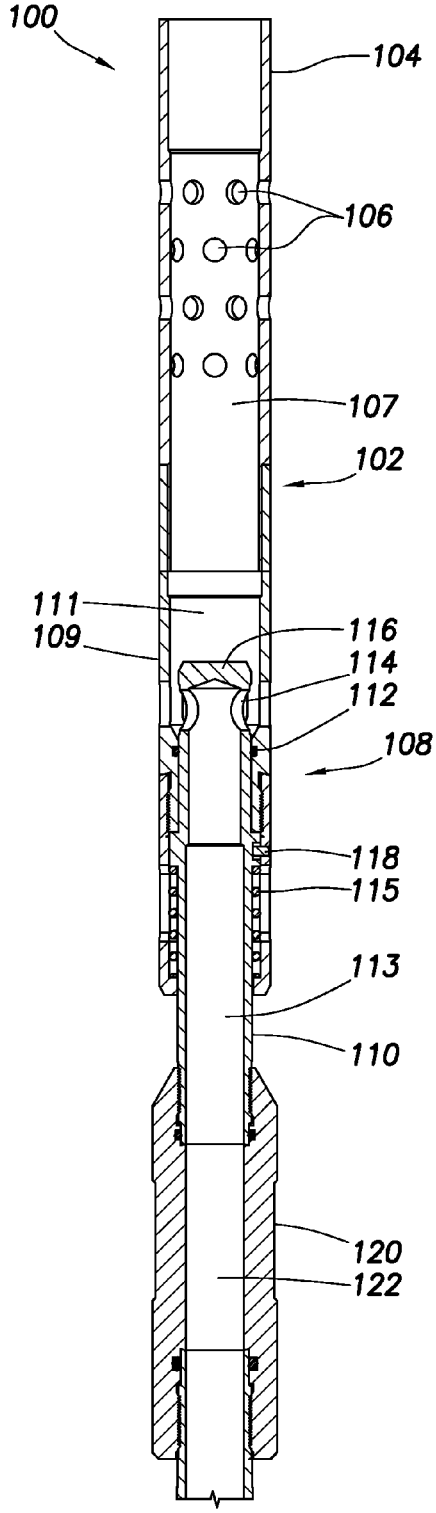
FIGS. 9A and 9B provide a cross sectional view of a positioning tool suitable for moving the run in prop in the fluid loss device in a first operating configuration.
Figure 10B:
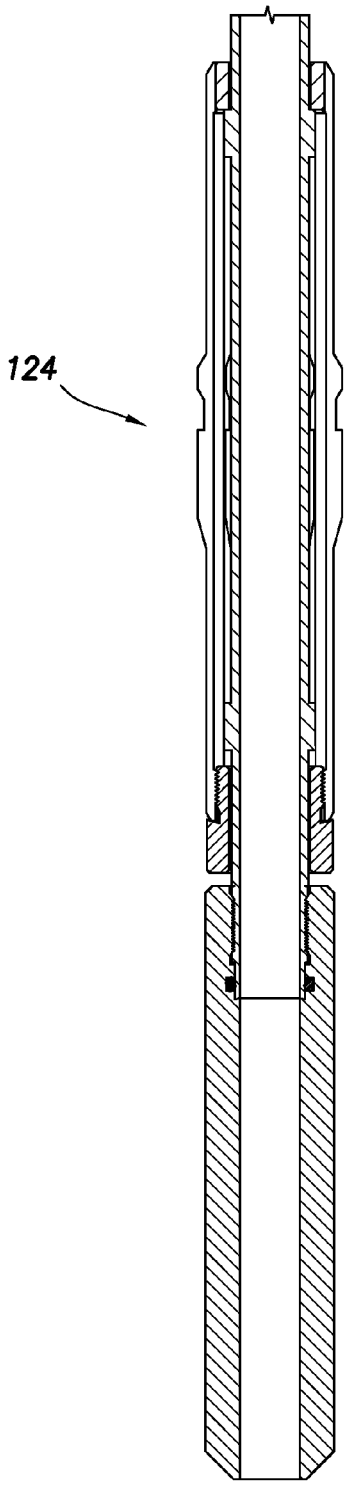
Figure 9B:
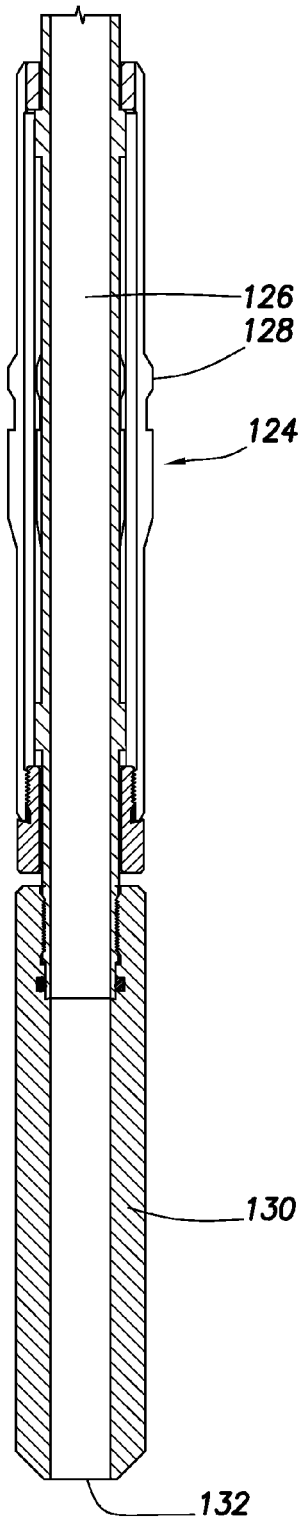

FIGS. 9A, and 9B illustrate the tool 100 in its run in condition. The tool 100 includes a connector section 102 that includes a threaded connector 104 on its upper end. The connector 104 may be threaded onto the lower end of a work string, for example to the lower end of a wash pipe in a gravel packing system. The section 102 is basically a hollow cylinder and includes perforations 106 that permit free flow of fluids into or out of a central bore 107 defined by section 102.

A sleeve valve 108 is connected to the lower end of section 102. The valve 108 in this embodiment is formed by an inner valve sleeve 110 that is slidably carried within an outer valve sleeve 109. The outer valve sleeve 109 may be threaded to the lower end of section 102, or if desired could be formed as an integral part with section 102. An O-ring 112 restricts flow of fluids between the exterior of inner sleeve 110 and the inner surface of outer sleeve 109. Side ports 114 near the upper end of inner sleeve 110 allow fluids to flow from a central bore 111 of outer sleeve 109 to a central bore 113 of inner sleeve 110, which is open on its lower end. Above the side ports 114, the inner sleeve 110 is closed by a cap 116. The inner sleeve 110 is held in its run in position relative to the outer sleeve 109 by shear screws or pins 118. The shear pins or screws 118 are selected to shear at a force less than is required to shear the pins or screws 48 that hold the run in prop 46 in its run in position. In the run in position, the valve 108 is open and allows fluids to flow freely between the central bores 107 and 111 above the valve 108 and a central bore 113 of inner sleeve 110 below the valve 108. While valve 108 is a sleeve valve in this embodiment, other forms of valves known in the art, e.g. a ball valve, may be used in place of a sleeve valve if desired.

In an alternate embodiment, the inner sleeve 110 may be held in its run in position relative to the outer sleeve 109 by a spring instead of shear screws or pins 118. For example, a coil spring 115 may be positioned between the shoulder in which shear pins 118 are shown in FIG. 9A on the inner sleeve 110 and the lower end of outer sleeve 109. The spring may be selected to be compressed by the force required to shear the shear pins 48 and thereby close the valve 108. Once closed, the valve 108 may remain closed due to pressure differentials so long as the positioning tool is in the fluid loss device 10. When the positioning tool is lifted above the fluid loss device 10, the spring may reopen the valve 108. When the valve 108 is reopened, the positioning tool is back in its run in condition and may be used to position another device, e.g. a flapper valve in another fluid loss device 10 positioned up hole.

An upper choke 120 is connected to the lower end of the inner valve sleeve 110. The choke 120 includes a central bore 122 that allows fluids flowing through the bore 113 of sleeve 110 to continue flowing through the choke 120. The outer diameter of choke 120 is selected to make a close fit with the inner surfaces of the lower connector 14, the opening prop 36, and upper connector 12 of the fluid loss device 10. If desired, elastomeric rings may be carried on the surface of choke 120 to form a fluid tight seal with the lower connector 14, the opening prop 36, and upper connector 12. A shifting tool 124 is connected to the lower end of the choke 120 and includes an open inner bore 126 in fluid communication with the bore 122. The shifting tool 124 includes profiles 128 on its outer surface adapted for engaging the run in prop 46 and moving it as described above to close the flapper 22. A lower choke 130 is connected to the lower end of the shifting tool 124 and includes an open central bore 132 in communication with the bore 126 in the shifting tool 124. The outer diameter of choke 130 is selected to make a close fit with the inner surfaces of the lower connector 14, the opening prop 36, and upper connector 12 of the fluid loss device 10. If desired, elastomeric rings may be carried on the surface of choke 130 to form a fluid tight seal with the lower connector 14, the opening prop 36, and upper connector 12.

While this embodiment includes both an upper choke 120 and a lower choke 130, the two chokes provide a single flow restriction function and may be considered to be a single choke. In some embodiments one or the other may be omitted from the positioning tool 100. For example, it may be desirable to use a longer upper connector 12 and rely on the upper choke 120 to restrict fluid flow between the positioning tool and the fluid loss device 10.

In a preferred embodiment, the inner surfaces of the lower connector 14, the opening prop 36, and upper connector 12 of the fluid loss device 10 may be machined or otherwise formed with close tolerances and a smooth surface, and may therefore be referred to as seal bores. Seal bores may be distinguished from the inner surfaces of typical oilfield tubulars that have fairly large diameter tolerances and may have surfaces that are not suitable for forming a fluid tight seal. The preferred seal bores allow the dimensions of chokes 120 and 130 to be selected to form a close fit with the inner surfaces of the lower connector 14, the opening prop 36, and upper connector 12 without unintentional interference between the parts. Such a close fit may substantially block flow between the parts without actual contact being required. The seal bores also allow use of elastomeric seals on the chokes 120 and 130 to form essentially fluid tight seals without damage that might otherwise occur due to sliding contact between the elastomeric seals and the seal bores.

In the run in configuration shown in FIGS. 9A and 9B, the positioning tool 100 includes an inner or bypass fluid flow path from the upper connector 102 through the valve 108 to the bottom of the lower choke 130. In a typical application, the tool 100 in its run in configuration may be attached by threaded connector 104 to the lower end of a wash pipe in a gravel packing system and positioned in a well below a sand screen that is to be gravel packed. A fluid loss device 10 may be included in the gravel packing system above the sand screen. After gravel packing the screen, the wash pipe is normally withdrawn from the well and the positioning tool 100 is also withdrawn with the wash pipe. As the wash pipe and positioning tool 100 are lifted in the well, the flow path through the tool 100 allows fluids to flow from the wash pipe and the annulus around the wash pipe down through the bypass flow path through tool 100. As a result of this free flow through the tool 100, little pressure differential exists across the positioning tool 100. Therefore, as the positioning tool enters and begins to pass through the fluid loss device 10, it will not tend to create a pressure differential across the flapper 22 and carrier 24. As the upper choke 120 passes through the lower connector 14, the opening prop 36, and upper connector 12, the close fit of these parts will substantially restrict flow of fluids between the choke 120 and inner surfaces of the lower connector 14, the opening prop 36, and upper connector 12. As a result, fluids flowing through the fluid loss device 10 are diverted to the inner bypass flow path in the positioning tool 100 and exit the device at the lower end of lower choke 130. Little or no pressure drop across the device 10 is created by the fluids flowing through the positioning tool 100.

The spacing between upper choke 120 and the shifter tool 124 is selected so that when the choke 120 is in the upper connector 12, the shifter tool 124 is in the run in prop 46 and the profiles 128 engage matching profiles in the inner surface of the run in prop 46. As the positioning tool is moved further up it applies force to move the run in prop 46 up to release the flapper 22. However, this force is resisted by the shear screws 48 holding the run in prop 46 in its run in position, and by the shear screws 118 holding the positioning tool 100 valve 108 in its open position. As noted above, the shear screws 118 are selected to shear at a lower force than the shear screws 48. Therefore, as the positioning tool 100 continues to move up, it will first shear the screws 118 and the valve sleeve 110 will move down relative to the sleeve 109, positioning the ports 114 below the O-ring 112 and closing the valve 108. In the alternative embodiment using a spring to hold the valve 108 in its run in open position, the spring will compress at a force less than required to shear screws 48 and the valve 108 will close. With the valve 108 closed, well fluids may no longer flow through the bypass flow path through positioning device 100. Flow around the device 100 is substantially restricted by the close fit of the upper choke 120 and lower choke 130 with inner surfaces of the lower connector 14, the opening prop 36, and upper connector 12.

As the positioning device 100 continues to move upward, the shear screws 48 are sheared and the run in prop 46 is moved by the shifter 124 to its open position shown in FIG. 2A. As this happens, the lower choke moves into the carrier 24. At this point, the run in prop 46 no longer holds the flapper 22 open, but the lower choke 130 is positioned adjacent the open flapper 22 and continues to hold the flapper 22 open. With continued upward movement of the positioning device 100, the upper end of the lower choke 130 enters the upper connector 12 and flow around the device 100 is substantially restricted by the lower choke 130 and upper connector 12. As the lower end of the lower choke moves above the flapper 22, the flapper is released and allowed to close with very little flow of fluids through the flapper as it closes.

It can be seen that the positioning device 100 operates by diverting or bypassing fluid flow through an inner bypass flow path as a fluid flow restricting device is moved past a flapper valve 20, then closing the inner flow path before closing the flapper 22. The device avoids or reduces pressure differentials that may otherwise occur across the flapper valve 20 both when the flow restricting device passes through the flapper 22 and when the flapper 22 is closed. However, the positioning device 100 is not essential for operation of the fluid loss device 10 and other shifting tools may be used if desired. The desirability of using the positioning device 100 depends primarily on environmental conditions present in a particular well. If a large flow of fluids is being lost into the productive formation, e.g. due to high overbalance pressure and high permeability, the device 100 may avoid problems caused by the flowing fluids. If the overbalance pressure is low and/or the formation has low permeability and/or has a low permeability filter cake layer, there may be little advantage in using the device 100.

It is also apparent that the positioning device 100 may provide an advantage when used to move or shift an element in any down hole device that also includes a pressure actuated element that could be actuated by a pressure differential caused by moving a shifting device into or through the down hole device.

While the present invention has been illustrated and described with reference to particular embodiments, it is apparent that various changes may be made, and parts may be substituted, within the scope of the invention as defined by the appended claims.

What we claim as our invention is:

1. A fluid loss device for use in a well, comprising:

a flapper, a valve seat adapted to form an interface with a first surface of the flapper, the interface adapted to hold pressure from above the flapper, a support capable of contacting at least a portion of a second surface of the flapper in response to pressure from below the flapper, the interface adapted to hold pressure from below the flapper in cooperation with the support; and a piston exposed to fluid pressure below the flapper, coupled to the valve seat, and in response to a pressure differential from below to above the flapper applying force urging the valve seat into contact with the flapper.

2. The fluid loss device according to claim 1, wherein the interface comprises a metal to metal contact between the valve seat and the flapper.

3. The fluid loss device according to claim 2, further comprising:

a non-metallic interface element carried on the valve seat adapted to hold pressure across the flapper.

4. The fluid loss device according to claim 3, wherein the non-metallic seal element comprises an elastomer and is carried in a groove formed in the valve seat interface surface.

5. A fluid loss device, for use in a well, comprising:

a flapper, a valve seat adapted to form an interface with a first surface of the flapper, the interface adapted to hold pressure from above the flapper; and a support capable of contacting at least a portion of a second surface of the flapper in response to pressure from below the flapper;

the interface adapted to hold pressure from below the flapper in cooperation with the support, wherein the flapper has a non-uniform thickness around its periphery, and the support has support surfaces shaped to mate with and provide suoport to areas around the periphery of the flapper, wherein the support surfaces each contact the flapper over from about 30 degrees to about 90 degrees of its periphery.

6. A fluid loss device for use in a well, comprising:

a flapper, a valve seat adapted to form an interface with a first surface of the flapper, the interface adapted to hold pressure from above the flapper; and a support capable of contacting at least a portion of a second surface of the flapper in response to pressure from below the flapper;

the interface adapted to hold pressure from below the flapper in cooperation with the support, wherein the flapper has a non-uniform thickness around its periphery, and the support has support surfaces shaped to mate with and provide support to areas around the periphery of the flapper, wherein the support surfaces each contact the flapper over about 60 degrees of its periphery.

7. A fluid loss device for use in a well, comprising:

a flapper, a valve seat adapted to form an interface with a first surface of the flapper, the interface adapted to hold pressure from above the flapper, a support capable of contacting at least a portion of a second surface of the flapper in response to pressure from below the flapper, the interface adapted to hold pressure from below the flapper in cooperation with the support, a flapper carrier positioned below the flapper, having the valve seat on an upper surface, and having a port adapted to allow fluid communication from above the flapper to below the flapper, and an opening prop slidably carried within the carrier and movable to a first position closing the carrier port, and to a second position opening the port.

8. The fluid loss device according to claim 7, wherein the opening prop is movable to a third position opening the flapper.

9. A method of operating a fluid loss device in an oil well, comprising:

positioning a flapper into contact with a valve seat forming a flapper valve seat interface on a first side of the flapper, applying a force to the valve seat urging the valve seat into contact with the flapper and the flapper into contact with a support on a second side of the flapper, holding pressure across the interface from the first side to the second side, and using fluid pressure from the first side of the flapper to apply a force to the valve seat, whereby the ability of the flapper to hold pressure from the first side is increased as the pressure from the first side is increased.

10. The method according to claim 9, wherein the fluid loss device comprises a flapper carrier and the valve seat is formed on a surface of the carrier, further comprising:

applying fluid pressure on the first side of the flapper to a surface of the carrier to apply a force to the valve seat.

11. The method according to claim 9, further comprising:

using a spring to apply a force to the valve seat.

12. A method of operating a fluid loss device in an oil well, comprising:

positioning a flapper into contact with a valve seat forming a flapper valve seat interface on a first side of the flapper, applying a force to the valve seat urging the valve seat into contact with the flapper and the flapper into contact with a support on a second side of the flapper, holding pressure across the interface from the first side to the second side, and contacting only selected peripheral portions of the flapper with the support, the selected peripheral portions comprising less than the flail circumference of the flapper.

13. A method of operating a fluid loss device in an oil well, comprising:

closing a flapper valve to isolate fluid above the flapper from fluids below the flapper valve, providing a pressure equalization flow path from above the flapper valve to below the flapper, the flow oath comprising a valve, and opening the flow path valve to substantially equalize pressure above and below the flapper, wherein the flapper valve comprises a flapper and a flapper carrier and the fluid loss device comprises an opening prop slidably carried in the flapper carrier, further comprising:

forming a port through a wall of the flapper carrier, the port forming part of the fluid equalization flow path;

closing the port with the opening prop in a first position; and, moving the opening prop to a second position and thereby opening the port.

14. The method of operating a fluid loss device according to claim 13, further comprising:

opening the flapper.

15. The method of operating a fluid loss device according to claim 13, further comprising:

flowing fluids through the pressure equalization flow path across an upper surface and hinge area of the flapper valve, whereby solids are removed from the upper surface and hinge area.

16. The method of operating a fluid loss device according to claim 13, further comprising:

moving the opening prop to a third position and thereby opening the flapper.

17. A method of operating a fluid loss device comprising a flapper valve in a well, comprising:

running the fluid loss device into a well with a run in prop positioned to hold the flapper valve open, moving the run in prop and thereby closing the flapper valve, and applying pressure to the flapper valve to release an opening prop and thereby opening the flapper valve.

18. The method of claim 17 further comprising using a positioning tool to move the run in prop and thereby closing the flapper valve.

19. The method of claim 17 further comprising increasing fluid pressure in the well to apply pressure to the flapper valve.

* * * * *